US008642878B2

(12) United States Patent
Hosler

(10) Patent No.: US 8,642,878 B2
(45) Date of Patent: Feb. 4, 2014

(54) PICKUP ASSEMBLIES, SYSTEMS AND METHODS FOR STRINGED INSTRUMENTS

(71) Applicant: Taylor-Listug, Inc., San Diego, CA (US)

(72) Inventor: David Hosler, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 0 days.

(21) Appl. No.: 13/655,233

(22) Filed: Oct. 18, 2012

(65) Prior Publication Data

US 2013/0160634 A1 Jun. 27, 2013

Related U.S. Application Data

(60) Provisional application No. 61/578,742, filed on Dec. 21, 2011.

(51) Int. Cl.
*G10H 3/14* (2006.01)

(52) U.S. Cl.
USPC ..... 84/730

(58) Field of Classification Search
USPC ..... 84/730, 731
See application file for complete search history.

(56) References Cited

U.S. PATENT DOCUMENTS

| | | | | |
|---|---|---|---|---|
| 3,453,920 | A * | 7/1969 | Scherer | 84/731 |
| 4,147,084 | A * | 4/1979 | Underwood | 84/731 |
| 4,211,139 | A * | 7/1980 | Murakami | 84/731 |
| 4,916,350 | A * | 4/1990 | Madden et al. | 310/338 |
| 5,206,449 | A * | 4/1993 | McClish | 84/723 |
| 5,925,839 | A * | 7/1999 | Schertler | 84/298 |
| 6,849,792 | B2 * | 2/2005 | Yeakel | 84/298 |
| 7,394,015 | B2 * | 7/2008 | Takabayashi | 84/731 |
| 2012/0103171 | A1 * | 5/2012 | Lashbrook | 84/731 |

* cited by examiner

*Primary Examiner* — Jeffrey Donels
(74) *Attorney, Agent, or Firm* — Sheppard Mullin Richter & Hampton LLP

(57) ABSTRACT

A pickup assembly is provided comprising a bridge defining an elongated slot, a saddle at least partially disposed within the slot, and at least one transducer. The slot has a slot end surface and two side walls. The saddle has a string contact surface, a saddle end surface generally opposite the string contact surface, and two opposing side surfaces. The at least one piezoelectric transducer may be located on a side wall of the slot, and have a contact surface in contact with a side surface of the saddle. The at least one transducer may be located on the slot end surface of the slot, and the contact surface contacts the saddle end surface of the saddle. An adjustment mechanism is connected to the bridge and engageable with the transducer. The transducer is adjustable relative to the saddle such that when the adjustment mechanism engages the transducer the force between the transducer and the saddle is adjusted.

24 Claims, 6 Drawing Sheets

PICKUP ASSEMBLIES, SYSTEMS AND METHODS FOR STRINGED INSTRUMENTS

REFERENCE TO RELATED APPLICATIONS

This application claims priority to U.S. Provisional Patent Application No. 61/578,742, filed Dec. 21, 2011, which is incorporated herein by reference in its entirety.

FIELD

The present disclosure relates to pickup assemblies for stringed instruments.

BACKGROUND

Sound pickups and amplification systems are used with various stringed instruments to sense string vibrations, convert those vibrations into electrical signals and amplify and project the resulting sound. One frequently employed technique for effecting this conversion is to use an "under saddle transducer." That is, at least one transducer is placed between the bottom of the vertical support or saddle, which provides the break point for the vibration of the one or more strings of the instrument, and the bridge, which supports the saddle. The transducer is given a tension preload via the downward pressure exerted by the one or more strings on the saddle. The amount of preload is related to the tension that has been placed on the string to bring it to the desired pitch.

However, known under saddle transducer pickup assemblies suffer from significant disadvantages associated with insufficient ability to adjust the amount of preload on the transducer. This is because the strings must press down on the transducer with equal pressure to adjust the output volume correctly. Such disadvantages range from a lack of "string-to-string" balance in a multi-stringed instrument, i.e., the electrical signal generated is not of a consistent level from one string to the next, to the addition of harmonic information that is not present in the natural vibrations.

Under saddle transducer pickup assemblies have other drawbacks. The saddle or other vertical support must be dimensioned precisely to be a "slip fit" into the slot of the bridge and cannot bind on the sides or ends, thus holding the saddle off the transducer in any location. Also, the bottom of the saddle must be uniform so it can lay evenly on the transducer, and the slot of the bridge must be completely flat to mate properly with the bottom of the transducer. The saddle material needs to be relatively consistent in density to transfer vibration equally. Even when under saddle transducers are fit properly in a slot of the bridge, they can become unequally compressed under the downward string tension on the saddle pushing down on the transducer, resulting in poor sound quality.

SUMMARY

The present disclosure, and its many embodiments, alleviate to a great extent the disadvantages of known pickup assemblies by providing a pickup assembly in which a transducer is located on a side (e.g., the front, the back, and one and/or both sides) of a saddle. In some embodiments, the transducer may be located on a vertical support other than the saddle. In addition, the position of the transducer is adjustable and can be moved in and out of contact with the saddle. In general, such pickup assemblies will more accurately reflect the movement of the one or more strings, the dynamics of the individual instrument, and the technique of the player. More particularly, the transducer is properly placed to provide the maximum amount of energy transfer and allows easy adjustment for both string balance and sound quality.

Embodiments of the pickup assembly comprise a bridge defining an elongated slot, a saddle at least partially disposed within the slot, and a transducer. In some embodiments, the transducer may comprise a piezoelectric transducer. The slot has a slot end surface and two side walls. The saddle has a string contact surface, a saddle end surface generally opposite the string contact surface, and two opposing side surfaces. The transducer is located on a side wall of the slot and has a contact surface in contact with a side surface of the saddle. The pickup assembly may further comprise at least one string in contact with the string contact surface of the saddle. In exemplary embodiments, the contact surface of the transducer is arranged generally perpendicular to the at least one string.

In exemplary embodiments, the transducer is adjustable relative to the side surface of the saddle. An adjustment mechanism may be connected to the bridge and be engaged with the transducer. In exemplary embodiments, the adjustment mechanism includes an actuator element, a preload arm element, and/or other elements. In exemplary embodiments, the actuator element comprises a screw. In exemplary embodiments, the preload arm element comprises a wedge element. The transducer may be held in place by force of compression between the side wall of the slot and the side surface of the saddle. The at least one transducer may comprise multiple transducers, and in exemplary embodiments, the multiple transducers are independently adjustable relative to each other. In some embodiments, the at least one transducer may comprise one transducer for each string of the guitar.

Exemplary embodiments include a pickup system for a stringed instrument, comprising a bridge defining an elongated slot, a saddle at least partially disposed within the slot, at least one transducer, and an adjustment mechanism for adjusting a force holding the transducer in contact with the saddle. In some embodiments, the transducer may comprise a piezoelectric transducer. The slot has a slot end surface and two side walls. The saddle has a string contact surface, a saddle end surface generally opposite the string contact surface, and one or more side surfaces. The transducer has a contact surface in contact with the saddle. The adjustment mechanism is connected to the bridge and engageable with the transducer, which is adjustable relative to the saddle such that when the adjustment mechanism engages the transducer the force holding the transducer in contact with the saddle is adjusted. The adjustment mechanism may include an actuator element, a preload arm element, and/or other elements. The actuator element may comprise a screw. The preload arm element may comprise a wedge element.

In exemplary embodiments, the transducer may be located on the slot end surface of the slot, and the contact surface of the transducer contacts the saddle end surface of the saddle. The transducer may also be located on a side wall of the slot, with the contact surface of the transducer contacting a side surface of the saddle. In exemplary embodiments, the transducer is held in place by force of compression between the slot and the saddle. The at least one transducer may comprise multiple transducers, and in exemplary embodiments the multiple transducers are independently adjustable relative to each other.

Thus, embodiments of the disclosure provide pickup assemblies wherein a transducer is located on a side of the saddle and a force holding the transducer in contact with the saddle is adjustable. Such pickup assemblies provide the maximum amount of energy transfer and allow easy adjustment for both string balance and sound quality. They more accurately reflect the movement of the one or more strings, the dynamics of the individual instrument, and the technique of the player. These and other features of the present disclosure will be appreciated from review of the following detailed description of the disclosure, along with the accompanying figures in which like reference numerals refer to like parts throughout.

BRIEF DESCRIPTION OF THE DRAWINGS

The foregoing and other objects of the disclosure will be apparent upon consideration of the following detailed description, taken in conjunction with the accompanying drawings, in which.

DETAILED DESCRIPTION

In the following paragraphs, embodiments of the present disclosure will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations on the present disclosure. As used herein, the "present disclosure" refers to any one of the embodiments of the disclosure described herein, and any equivalents. Furthermore, reference to various aspects of the disclosure throughout this document does not mean that all claimed embodiments or methods must include the referenced aspects.

Figure 1:
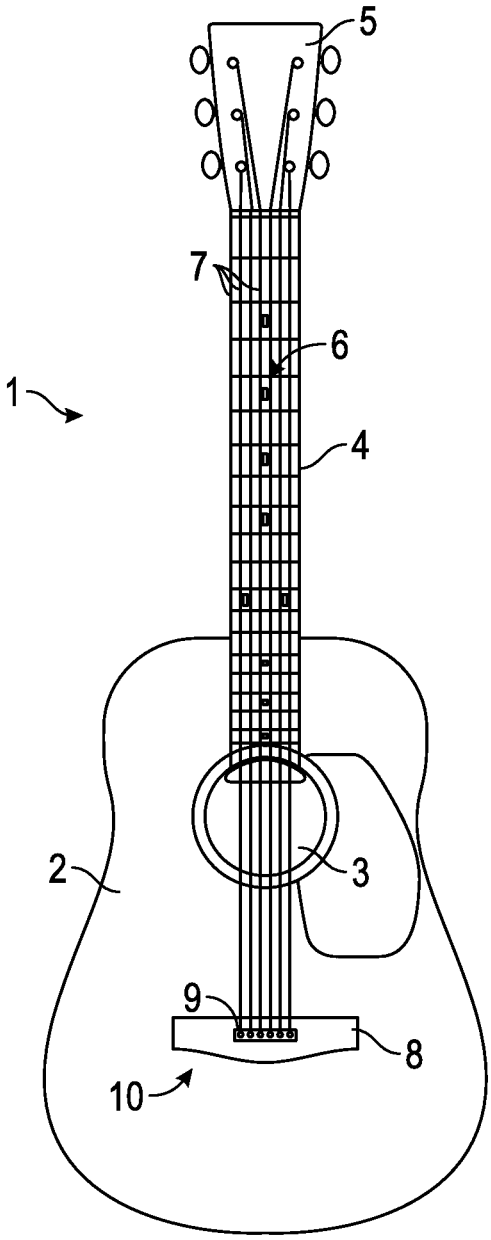
FIG. 1 is a perspective view of an exemplary guitar in accordance with the present disclosure.

FIGS. 1-6 illustrate exemplary embodiments of an adjustable pickup assembly 10. In FIG. 1, a guitar 1 employing an embodiment of a pickup assembly 10 can be seen. Guitar 1 is an acoustic instrument having a hollow body 2, the top of which defines a substantially circular cutout 3. A neck 4 extends from cutout 3 to a peg head 5 and includes a fret board 6. A plurality of strings 7 extends from a bridge 8 over a saddle 9, cutout 3 and fret board 6 to peg head 5.

Figure 2A:
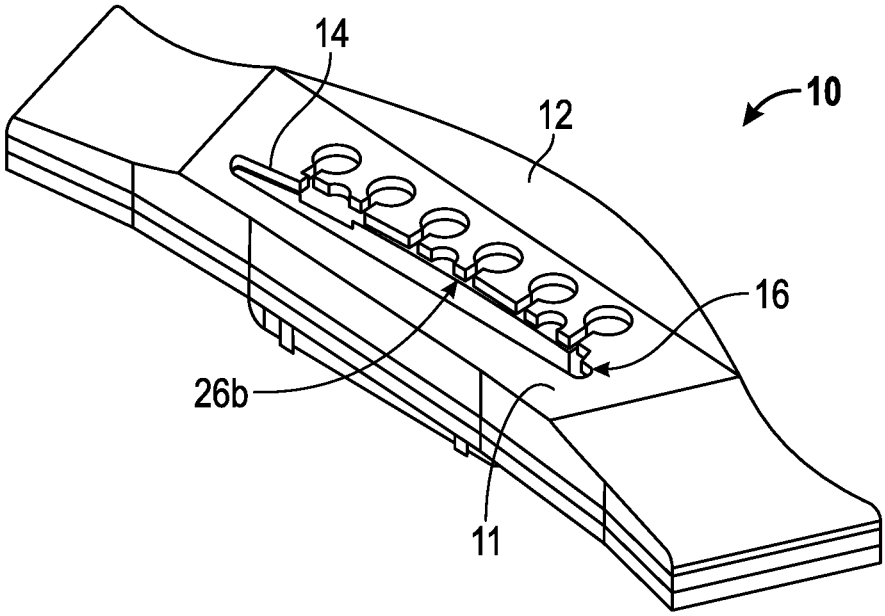
FIG. 2A is a perspective view of an embodiment of a pickup assembly in accordance with the present disclosure.
Figure 2B:
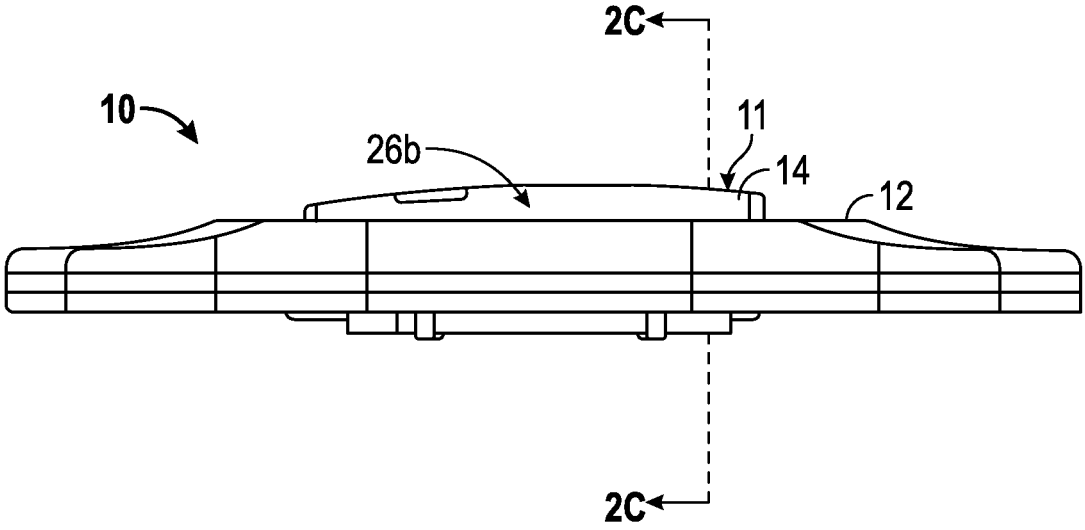
FIG. 2B is a rear view of an embodiment of a pickup assembly in accordance with the present disclosure.
Figure 2C:
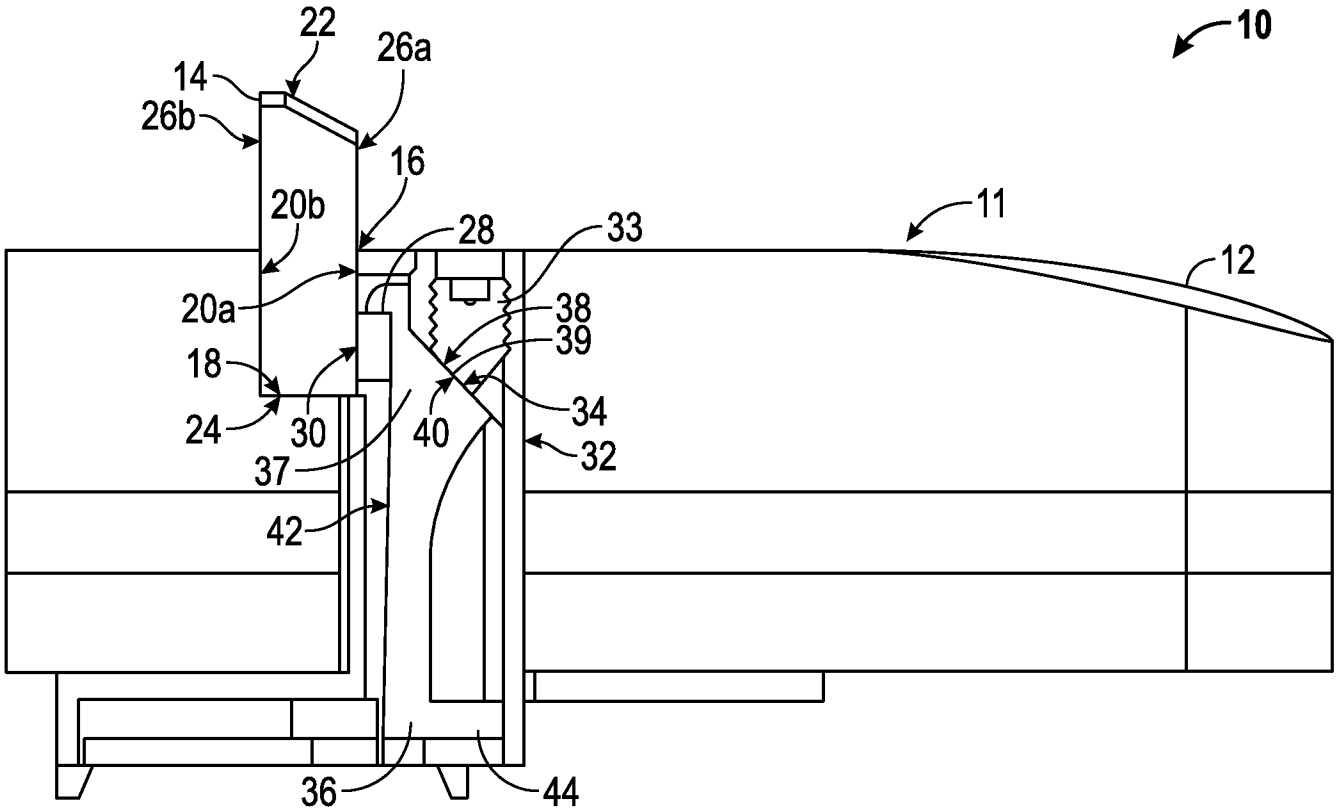
FIG. 2C is a side cross-sectional view of an embodiment of a pickup assembly in accordance with the present disclosure.

Turning to FIGS. 2A-2C, pickup assembly 10 comprises a bridge 12 and a saddle 14 at least partially disposed with an elongated slot 16 defined in a first surface 11 of bridge 12. Slot 16 is generally transversely defined in bridge 12 and has a generally rectangular cross section with a slot end surface 18 and two side walls 20*a*, 20*b*. Bridge 12 is typically made of wood, and saddle 14 typically of bone or plastic, but these components may be made of any suitable material. Saddle 14 has a string contact surface 22, a saddle end surface 24 generally opposite string contact surface 22, and two opposing side surfaces 26*a*, 26*b*. Saddle end surface 24 of saddle 14 is loosely engaged by slot 16 and rests upon slot end surface 18 of slot 16.

Figure 3A:
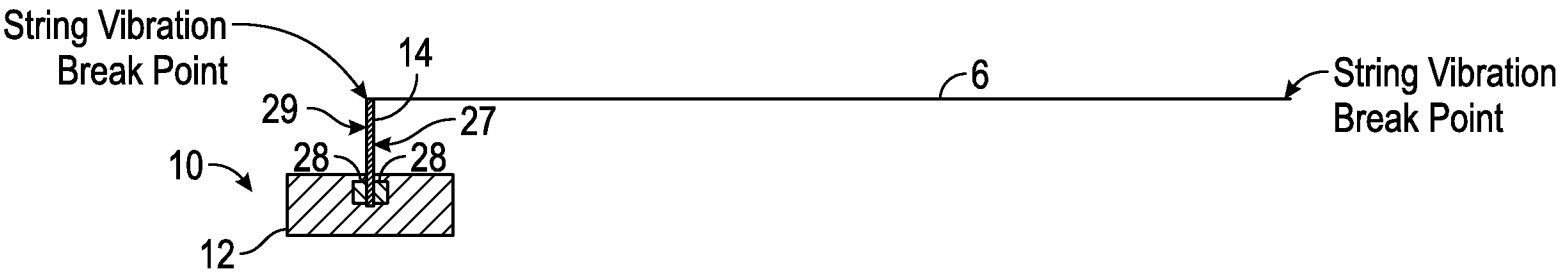
FIG. 3A is a schematic of an embodiment of a pickup assembly in accordance with the present disclosure shown in operation with a string.
Figure 3B:
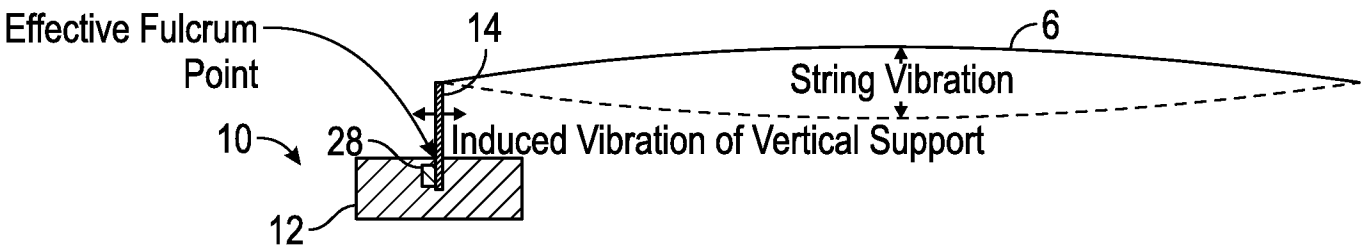
FIG. 3B is a schematic of an embodiment of a pickup assembly in accordance with the present disclosure shown in operation with a string.

Pickup assembly 10 further comprises at least one transducer 28 located on side wall 20*a* of slot 16. In some embodiments, transducer 28 may be located on a side wall of slot 16 other than side wall 20*a*. This disclosure contemplates that transducer 28 may contact saddle 14 at any location on any side wall. In some embodiments, transducer 28 may comprise a piezoelectric transducer and/or other transducers. In some embodiments, transducer 28 may comprise multiple transducers. In some embodiments, transducer 28 may comprise one transducer for each string of the guitar. A contact surface 30 of transducer 28 is generally located to contact side surface 26*a* of saddle 14. It should be noted that any number of transducers could be used, and they could be located to contact one or more of a front side (not shown in FIGS. 2A-2C), a back side (not shown in FIGS. 2A-2C), side 26*a*, side 26*b*, and/or other areas of saddle 14. In some embodiments, transducer 28 may be located on a vertical support other than saddle 14. An exemplary front side-mounted (e.g., side 20*a* of slot 16 in contact with side 26*a* of saddle 14) embodiment is shown in FIGS. 2A-2C, and an exemplary back side-mounted (e.g., side 20*b* of slot 16 in contact with side 26*b* of saddle 14) embodiment is shown in FIG. 3B. An exemplary embodiment of pickup assembly 10 having two transducers 28 mounted on both the front 27 and back 29 sides of saddle 14 is shown in FIG. 3A, wherein transducer 28 contacts the edge of saddle 14 that is most parallel to its own plane. By mounting transducer 28 in this way, it more accurately reflects the movement of the instrument strings, the dynamics of the instrument, and the technique of the player.

Figure 4:
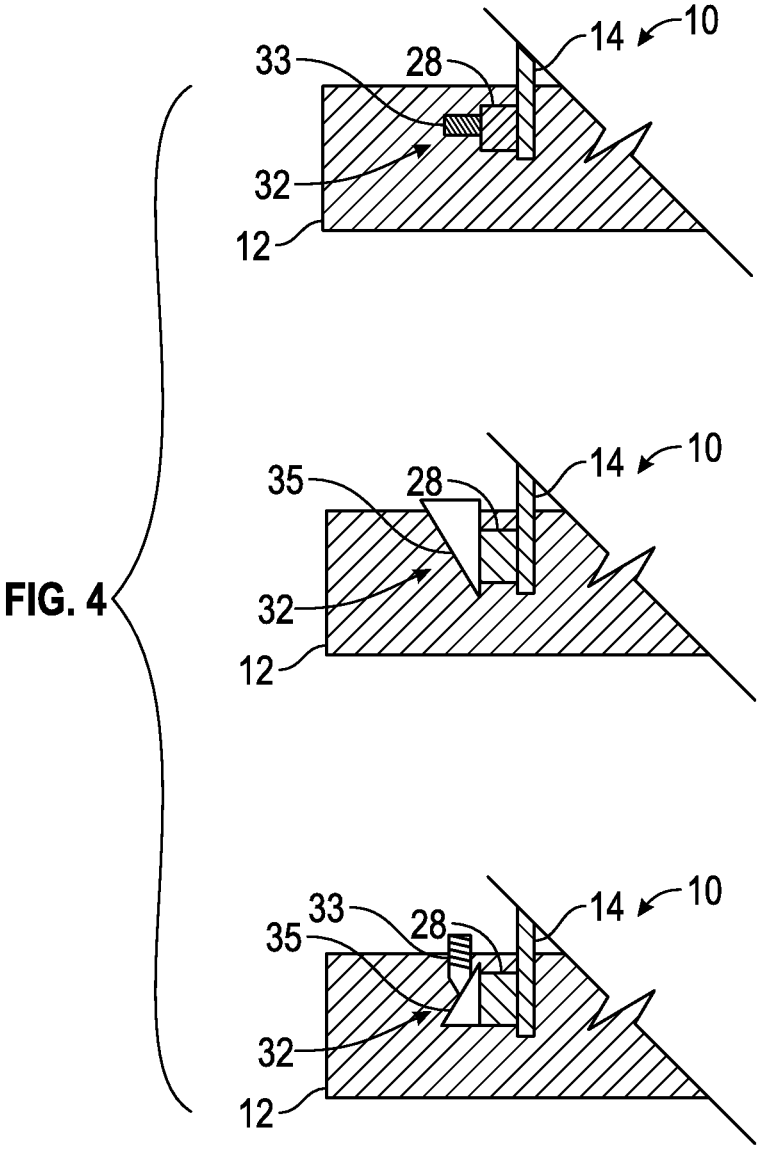
FIG. 4 is a schematic of an embodiment of a pickup assembly in accordance with the present disclosure shown in operation.

Furthermore, by mounting transducer 28 on side wall 20*a* and/or 20*b* of slot 16 in contact with side surface 26*a* and/or 26*b* of saddle 14, it facilitates utilization of an adjustment mechanism 32 to adjust the amount of preload placed on transducer 28. Adjustment mechanism 32 may be configured to adjust a force (e.g., pressure) holding transducer 28 in contact with saddle 14. As best seen in FIG. 2C, adjustment mechanism 32 is provided and movable connected to the bridge 12. Adjustment mechanism 32 is configured to engage transducer 28. Adjustment mechanism 32 includes an actuator element 33 and a preload arm element 36. Actuator element 33 is disposed within an aperture 34 defined in bridge 12 and located close to slot 16. Actuator element 33 may be a screw or any other component that is configured to exert force (e.g., pressure) on preload arm element 36. Preload arm element 36 is disposed within a space defined in bridge 12 so that a portion 37 of the preload arm element forms a preload mating surface 38 that mates with an actuator mating surface 40 near a portion 39 of actuator element 33. As shown in FIG. 4, exemplary embodiments of adjustment mechanism 32 could include actuator element 33 directly abutting transducer 28, a wedge element 35 that directly abuts transducer 28, or a combination of actuator element 33 and wedge element 35 abutting a transducer 28.

In exemplary embodiments, preload mating surface 38 and actuator mating surface 40 (shown in FIG. 2C) are angled surfaces relative to the planar surfaces of preload arm element 36 and actuator element 33, respectively. A side 42 of preload arm element 36 opposite preload mating surface 38 is in physical contact with transducer 28. As described in more detail herein, actuation of actuator element 33 exerts force on preload mating surface 38 and causes opposite side 42 of preload arm element 36 to press transducer 28 closer to saddle 14. Exemplary embodiments of preload arm element 36 may include a foot and/or flange 44 to help secure preload aim element 36 to bridge 12.

Figure 5:
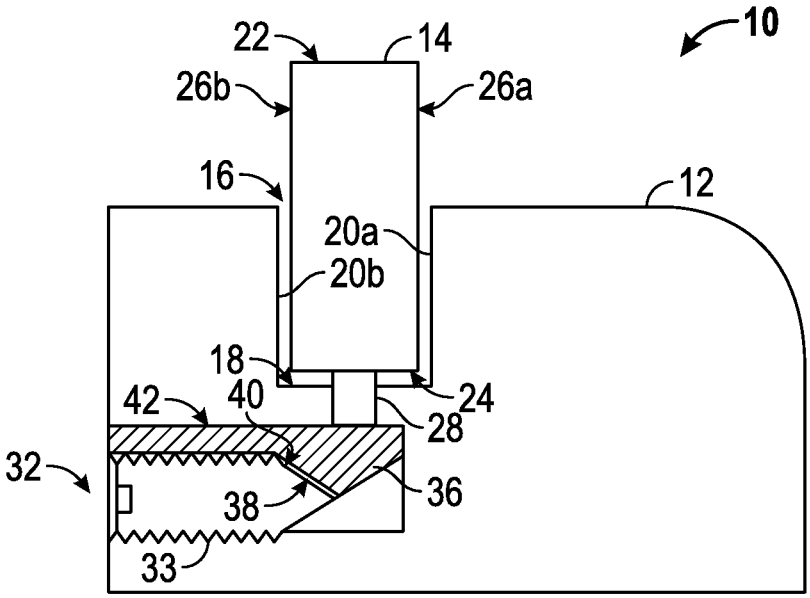
FIG. 5 is a side cross-sectional view of an embodiment of a pickup assembly in accordance with the present disclosure.
Figure 6:
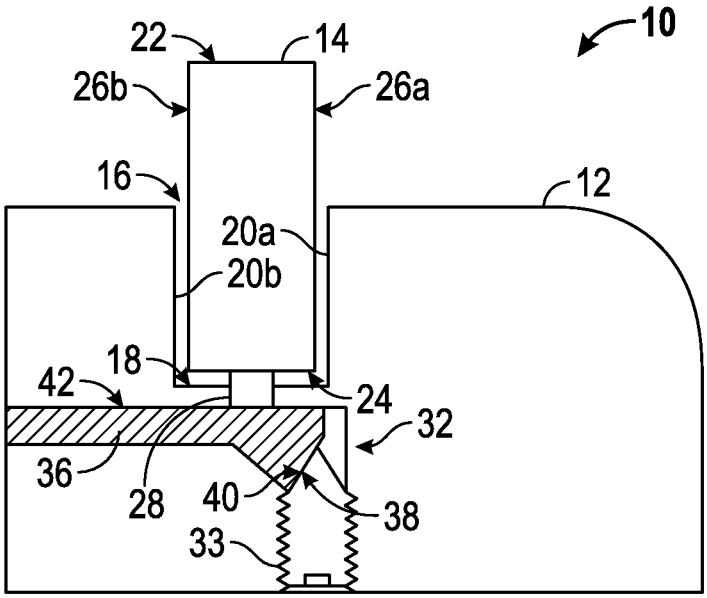
FIG. 6 is a side cross-sectional view of an embodiment of a pickup assembly in accordance with the present disclosure.

Referring to FIGS. 5-6, in exemplary embodiments of pickup assembly 10 transducer 28 may be mounted underneath saddle 14 in slot end surface 18 of slot 16. In embodiments where transducer 28 is mounted underneath saddle 14, bridge 12, saddle 14, and transducer 28 are configured such that forces from guitar strings on saddle 14 are carried by bridge 12 and not transducer 28. Contact surface 30 of transducer 28 is in contact with saddle end surface 24 of saddle 14. Adjustment mechanism 32 could be provided in one of a variety of configurations. An exemplary configuration of the adjustment mechanism is shown in FIG. 5 in which preload arm element 36 and actuator element 33 are both disposed horizontally within a rear aperture of bridge 12. In this configuration, side surface 42 opposite preload mating surface 38 presses on transducer 28 when actuator element 33 is moved laterally inward and actuator mating surface 40 exerts pressure on preload mating surface 38 of the preload arm element.

In an exemplary embodiment illustrated in FIG. 6, preload arm element 36 is disposed horizontally within a rear aperture of bridge 12, and actuator element 33 is disposed vertically upward within a bottom aperture of bridge 12. In this configuration, side surface 42 opposite preload mating surface 38 presses on transducer 28 when actuator element 33 is moved vertically upward and actuator mating surface 40 exerts pressure on preload mating surface 38 of the preload arm element.

In operation, the user may adjust a level of contact force (e.g., contact pressure) between transducer 28 and saddle 14, thereby enhancing sound quality, by conducting the following steps. To increase the force (e.g., preload pressure) on transducer 28, the user actuates actuator element 33 of adjustment mechanism 32. More particularly, if actuator element 33 is a screw, the user engages actuator element 33 with a screwdriver, wrench, and/or other devices to rotate and/or manipulate actuator element 33 in other ways such that actuator mating surface 40 exerts force on preload mating surface 38 of preload arm element 36. This actuating force travels through actuator mating surface 40 to preload mating surface 38 and moves preload arm element 36 toward transducer 28. Specifically, opposite side 42 of preload arm element 36 presses transducer 28 closer to saddle 14.

To reduce the force (e.g., preload pressure) on transducer 28, the user rotates actuator element 33 of adjustment mechanism 32 in a loosening direction and/or manipulates actuator element 33 in other ways such that actuator element 33 moves in a direction that relieves the force on the preload aim element 36. The movement of actuator element 33 relieves the force (e.g., pressure) of actuator mating surface 40 on preload mating surface 38 of preload arm element 36. Thus, opposite side 42 of preload arm element 36 moves away from, and reduces the force on, transducer 28. Transducer 28, in turn, moves away from, and reduces the force on, saddle 14.

The user may make any number of small adjustments to the force (e.g., preload pressure) of transducer 28 on saddle 14 by moving actuator element 33 in very small increments. The near infinite adjustment afforded by adjustment mechanism 32 provides fine control over the preload pressure and therefore, the harmonic content of the instrument and other aspects of sound quality. As will be appreciated by those of skill in the art, embodiments of pickup assembly 10 described herein can be used with other stringed musical instruments, including, but not limited to, violins, cellos, basses, sitars, mandolins, violas, and pianos without departing from the scope of the present disclosure.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A pickup assembly comprising:

a bridge defining an elongated slot, the slot having a slot end surface and two side walls;

a saddle at least partially disposed within the slot, the saddle having a string contact surface, a saddle end surface generally opposite the string contact surface, and two opposing side surfaces; and at least one transducer located on a side wall of the slot, the transducer having a transducer contact surface in contact with a side surface of the saddle, wherein a force holding the transducer contact surface in contact with the side surface of the saddle is adjustable.

2. The pickup assembly of claim 1, wherein the at least one transducer comprises at least one piezoelectric transducer.

3. The pickup assembly of claim 2, wherein the at least one piezoelectric transducer comprises multiple piezoelectric transducers.

4. The pickup assembly of claim 1, further comprising at least one string in contact with the string contact surface of the saddle.

5. The pickup assembly of claim 4, wherein the transducer contact surface is arranged generally perpendicular to the at least one string.

6. The pickup assembly of claim 1, further comprising an adjustment mechanism configured to engage the transducer and adjust the force holding the transducer contact surface in contact with the side surface of the saddle, the adjustment mechanism comprising an actuator element and a preload arm element, wherein actuation of the of actuator element causes the preload arm element to adjust the force.

7. The pickup assembly of claim 6, wherein the preload arm element comprises a wedge element.

8. The pickup assembly of claim 1, wherein the at least one transducer comprises multiple piezoelectric transducers, and wherein forces holding the multiple piezoelectric transducers in contact with the side surface of the saddle are independently adjustable relative to each other.

9. A pickup system for a stringed instrument, comprising:

a bridge defining an elongated slot, the slot having a slot end surface and two side walls;

a saddle at least partially disposed within the slot, the saddle having a string contact surface, a saddle end surface generally opposite the string contact surface, and one or more side surfaces;

at least one transducer having a transducer contact surface in contact with the saddle; and an adjustment mechanism configured to engage the transducer and adjust a force holding the transducer contact surface in contact with the saddle, the adjustment mechanism comprising an actuator element and a preload arm element, wherein actuation of the of actuator element causes the preload arm element to adjust the force.

10. The pickup system of claim 9, wherein the preload arm element comprises a wedge element.

11. The pickup system of claim 9, wherein the at least one transducer is located on the end surface of the slot, and the transducer contact surface contacts the end surface of the saddle.

12. The pickup system of claim 9, wherein the at least one transducer is located on a side wall of the slot, and the transducer contact surface contacts a side surface of the saddle.

13. The pickup system of claim 9, wherein the at least one transducer comprises at least one piezoelectric transducer.

14. The pickup system of claim 13, wherein the at least one piezoelectric transducer comprises multiple piezoelectric transducers.

15. The pickup system of claim 14, wherein forces holding the multiple piezoelectric transducers in contact with the saddle are independently adjustable relative to each other.

16. A pickup assembly comprising:

a saddle having a string contact surface, a saddle end surface generally opposite the string contact surface, and one or more side surfaces; and at least one transducer having a transducer contact surface in contact with a side surface of the saddle wherein a force holding the transducer contact surface in contact with the side surface of the saddle is adjustable.

17. The pickup assembly of claim 16, wherein the at least one transducer comprises at least one piezoelectric transducer.

18. The pickup assembly of claim 16, further comprising at least one string in contact with the string contact surface of the saddle, and wherein the transducer contact surface is arranged generally perpendicular to the at least one string.

19. The pickup assembly of claim 16, the assembly further comprising an adjustment mechanism configured to engage the transducer and adjust the force holding the transducer contact surface in contact with the side surface of the saddle, the adjustment mechanism comprising an actuator element and a preload arm element, wherein actuation of the of actuator element causes the preload arm element to adjust the force.

20. The pickup assembly of claim 19, wherein the preload arm element comprises a wedge element.

21. A method of adjusting a pickup assembly to enhance sound quality, the pickup assembly including a saddle, at least one transducer in contact with the saddle, and an adjustment mechanism for adjusting a force holding the transducer in contact with the saddle, the method comprising:

increasing the force holding the transducer in contact with the saddle; or decreasing the force holding the transducer in contact with the saddle, wherein the force holding the transducer contact surface in contact with the side surface of the saddle is adjustable.

22. The method of claim 21, wherein increasing the force comprises actuating an actuator element of the adjustment mechanism.

23. The method of claim 22, wherein actuating the actuator element comprises rotating the actuator element in a predetermined direction.

24. The method of claim 21, wherein decreasing the force comprises rotating the actuator element in a predetermined loosening direction.

* * * * *

UNITED STATES PATENT AND TRADEMARK OFFICE

CERTIFICATE OF CORRECTION

PATENT NO. : 8,642,878 B2
APPLICATION NO. : 13/655233
DATED : February 4, 2014
INVENTOR(S) : David Hosler It is certified that error appears in the above-identified patent and that said Letters Patent is hereby corrected as shown below:

In the Specification

Column 5, line 5: “preload aim” should be -- preload arm --.

Column 5, line 52: “preload aim” should be -- preload arm --.

Signed and Sealed this
Fifteenth Day of April, 2014

Michelle K. Lee

Michelle K. Lee
*Deputy Director of the United States Patent and Trademark Office*